US009115449B2

(12) United States Patent
Burckhardt et al.

(10) Patent No.: US 9,115,449 B2
(45) Date of Patent: Aug. 25, 2015

(54) NEEDLING DEVICE

(75) Inventors: Theodor Burckhardt, Arlesheim (CH); Heiner Hausdorf, Zwingen (CH); Thomas Jermann, Allschwil (CH); Francis Wisson, St. Louis (FR)

(73) Assignee: Burckhardt of Switzerland AG, Basel (CH)

( * ) Notice: Subject to any disclaimer, the term of this patent is extended or adjusted under 35 U.S.C. 154(b) by 121 days.

(21) Appl. No.: 14/002,295

(22) PCT Filed: Feb. 24, 2012

(86) PCT No.: PCT/EP2012/053203

§ 371 (c)(1),
(2), (4) Date: Aug. 29, 2013

(87) PCT Pub. No.: WO2012/116936

PCT Pub. Date: Sep. 7, 2012

(65) Prior Publication Data

US 2013/0333171 A1 Dec. 19, 2013

(30) Foreign Application Priority Data

Mar. 1, 2011 (CH) ..... 355/11

(51) Int. Cl.

| | |
|---|---|
| ***B26F 1/20*** | (2006.01) |
| ***B26D 1/00*** | (2006.01) |
| ***D04H 18/02*** | (2012.01) |
| ***B26F 1/14*** | (2006.01) |
| ***D04H 13/02*** | (2006.01) |
| ***D04H 18/00*** | (2012.01) |
| ***D01D 5/42*** | (2006.01) |

(52) U.S. Cl.

CPC ..... *D04H 18/02* (2013.01); *B26D 1/0006* (2013.01); *B26F 1/14* (2013.01); *B26F 1/20* (2013.01); *D01D 5/426* (2013.01); *D04H 13/02* (2013.01); *D04H 18/00* (2013.01)

(58) Field of Classification Search

CPC ..... D04H 13/02; D04H 18/00; D04H 18/02; B26D 2001/006; B26D 1/626; B26F 1/14; B26F 1/20; D01D 5/42; D01D 5/423; D01D 5/426

USPC ..... 28/115, 170

See application file for complete search history.

(56) References Cited

U.S. PATENT DOCUMENTS 232,962 A * 10/1880 Harrington ..... 428/139
1,102,143 A * 6/1914 Cooper ..... 28/144

(Continued)

FOREIGN PATENT DOCUMENTS

CA 2221074 A1 7/1999
CN 2889653 Y 4/2007

(Continued)

*Primary Examiner* — Amy Vanatta
(74) *Attorney, Agent, or Firm* — The Webb Law Firm

(57) ABSTRACT

A needle device for processing an in particular strip-shaped planar structure comprises a needle bed, on which a plurality of needle elements provided with tips are arranged in such a manner that the needle elements protrude from the needle bed and the tips thereof point away from the needle bed. The needle elements are designed as flat blades each of which having at least one cutting edge extending from the tip of the needle element toward the needle roller. The needle elements are fastened via leg-shaped mounting members in bar-like needle carriers, which are in turn inserted in grooves of the needle roller.

10 Claims, 5 Drawing Sheets

(56) References Cited

U.S. PATENT DOCUMENTS

| | | | | |
|---|---|---|---|---|
| 1,486,317 | A * | 3/1924 | Barry | 76/104.1 |
| 3,460,416 | A * | 8/1969 | Gilbert | 83/30 |
| 3,527,393 | A * | 9/1970 | Matsui et al. | 225/97 |
| 3,536,238 | A | 10/1970 | Iwama et al. | |
| 3,565,308 | A * | 2/1971 | Slack | 264/DIG. 47 |
| 3,577,724 | A * | 5/1971 | Greene | 57/31 |
| 3,646,639 | A | 3/1972 | Burckhardt et al. | |
| 4,498,217 | A * | 2/1985 | Engels | 26/9 |
| 4,531,265 | A * | 7/1985 | Engels | 26/9 |
| 4,542,705 | A | 9/1985 | Orth | |
| 4,627,131 | A | 12/1986 | Iwata | |
| 5,151,077 | A * | 9/1992 | Cole, Jr. et al. | 493/353 |
| 5,214,833 | A | 6/1993 | Yada | |
| 2013/0052293 | A1 | 2/2013 | Weinhold | |
| 2013/0055536 | A1 | 3/2013 | Weinhold et al. | |

FOREIGN PATENT DOCUMENTS

| | | | |
|---|---|---|---|
| DE | 1660487 | | 7/1970 |
| DE | 1907007 | | 8/1970 |
| DE | 4223131 | A1 | 1/1993 |
| DE | 29619357 | U1 | 4/1998 |
| EP | 0109571 | A1 | 5/1984 |
| FR | 91640 | | 7/1968 |
| FR | 2329776 | A1 | 5/1977 |
| JP | 47009812 | A | 5/1972 |
| JP | 51012742 | B1 | 4/1976 |
| JP | 63247011 | A | 10/1988 |
| JP | 7164547 | A | 6/1995 |
| JP | 8158234 | A | 6/1996 |
| WO | 9748508 | A1 | 12/1997 |
| WO | 2009137389 | A1 | 11/2009 |
| WO | 2010012729 | A2 | 2/2010 |
| WO | 2011138261 | A1 | 11/2011 |
| WO | 2011138263 | A1 | 11/2011 |

* cited by examiner

NEEDLING DEVICE

CROSS-REFERENCE TO RELATED APPLICATIONS

This application is the United States national phase of International Application No. PCT/EP2012/053203 filed Feb. 24, 2012, and claims priority to Switzerland Patent Application No. 355/11 filed Mar. 1, 2011, the disclosures of which are hereby incorporated in their entirety by reference.

BACKGROUND OF THE INVENTION

1. Field of the Invention

The invention relates to a needle device, to a use of such a needle device, and to a method for manufacturing such a needle device.

2. Description of Related Art

In the processing of a planar structure that is referred to as "fibrillation", a stretched band of synthetic film, made from polypropylene for example, is split by aligning the molecule chains or polymer threads in parallel longitudinal strips. Previously, fibrillation has been performed using a needle roller equipped with radially protruding needles that have a substantially round cross section. The synthetic band is stretched and passed over the rotating needle roller, so that the needles gently prick the band and cause the splitting. However, such needle rollers with round needles do not work well, or fail entirely, with more elastic synthetic materials that contain more polyethylene and fewer parallel chains, for example, as the needles tend to tear the synthetic band because the elastic material does not have splitting properties.

In this context, it is intended to improve a needle device of such kind having round needles in such a manner that it may also be used to fibrillate more elastic synthetic materials.

A needle device of the generic type, comprising a rotatable roller the circumference of which is fitted with triangular blades, each having one cutting edge and the tips of which protrude from the roller, is known from CN 2 889 653 Y. The blades are mounted in dovetail grooves in the roller by means of connecting elements. One disadvantage of this needle device is that mounting and replacing the individual blades in the grooves in the roller is very labour-intensive.

SUMMARY OF THE INVENTION

The object underlying the present invention is therefore to provide a needle device of the type described in the introduction, the needle elements of which may be mounted simply and worn needle elements can be replaced simply and quickly.

The essence of the invention consists in the following: A needle device comprises a needle bed, on which a plurality of needle elements provided with tips are arranged in such a manner that the needle elements protrude from the needle bed and the tips thereof point away from the needle bed. The needle elements are designed as flat blades each of which having at least one cutting edge extending from the tip of the needle element toward the needle bed. According to the invention, the needle elements are inserted in bar-like needle carriers, which are in turn fastened on or in the needle bed.

Mounting the needle elements in the needle bed is simplified by fastening the needle elements to dedicated needle carriers. Worn needle elements can also be replaced easily. The configuration of the needle elements as flat, planar blades with one cutting edge is particularly advantageous for fibrillating applications of the needle device. With such needle elements it is also possible to fibrillate films made from plastics that are less parallelized and thus more elastic.

According to a preferred embodiment, the portions of the needle elements protruding from the needle bed each have a substantially triangular shape with a base edge located opposite the tip and two side edges extending from the base edge to the tip, wherein at least one of the side edges, and preferably both, is/are designed as a cutting edge. The substantially triangular shape of the needle elements has proven to be particularly advantageous and usable in a wide range of different applications of the needle device.

Advantageously, each of the two side edges is designed as a cutting edge. This makes it possible to use both sides of the needle elements.

The needle elements are advantageously equipped with at least one, preferably two, leg-shaped mounting members extending away from the base edge for fastening to the needle bed or the needle carrier. These mounting members represent a simple design whereby the needle elements can be fastened effectively and the alignment thereof assured.

According to a further advantageous embodiment, the needle carriers comprise mounting openings, in which the leg-shaped mounting members of the needle elements engage. This engagement of the leg-shaped mounting members in the mounting openings ensures that the needle elements are fastened in the needle carrier easily and securely.

In this context, the needle elements are advantageously supported with their base edges on the needle carriers. This provides good support and stability for the needle elements.

The needle elements are advantageously glued into the bar-like needle carriers by their leg-shaped mounting members. This is a particularly expedient and relatively uncomplicated fastening method.

According to a particularly advantageous embodiment, the cross-sections of the bar-like needle carriers have a substantially dovetail shape, and each comprises two side parts that are preferably inclined toward one another and a bridge part connecting said side parts. The dovetail configuration enables the needle carriers to be mounted on the needle roller in a particularly simple manner. For this purpose, the needle carriers are preferably inserted detachably in grooves in the needle bed.

The mounting openings are advantageously each arranged in the bridge portion of the needle carriers, wherein the leg-shaped mounting members of the needle elements pass through the mounting openings and extend into a hollow space formed in the needle carriers by the side parts and the bridge part of the needle carriers, and wherein the hollow space is filled with an adhesive at least in the area of the mounting members. This method of fastening the needle elements is particularly simple and efficient and may be carried out together for all needle elements to be fastened to each needle carrier for example by filling the hollow space along the entire length of the needle carrier with adhesive. Finally, the mounting openings may be produced relatively simply since they may be normal drill holes.

According to a preferred embodiment, the needle elements are orientated on the needle carriers in such a manner that the flat sides or central planes thereof are at an angle from 0°-90°, particularly 0°, to a normal plane perpendicular to a longitudinal direction of the needle carriers. The orientation at an angle of 0° or close to 0° is particularly suitable for fibrillating applications of the needle device. For simple perforation applications, on the other hand, the needle elements are orientated at an angle of 90° or almost 90°.

According to a particularly practical embodiment, the needle bed of the needle device according to the invention is designed as a needle roller.

A preferred use of the needle device according to the invention is fibrillation, particularly of band-like planar structures, more particularly plastic strips of polyethylene or polypropylene for example.

In a particularly advantageous method for manufacturing the needle device according to the invention, the needle elements are fabricated out of a flat blade having at least one cutting edge, for example by punching or cutting, particularly with the aid of a laser, in such a manner that the cutting edges of the needle elements are each formed by a portion of the cutting edge of the blade.

BRIEF DESCRIPTION OF THE DRAWINGS

In the following, the invention will be described in greater detail with reference to the accompanying drawings and based on various embodiments thereof. In the drawings.

DESCRIPTION OF THE INVENTION

The following applies with regard to the following description: If reference signs are used in a figure in order to clarify the illustration, but not cited in the descriptive section associated directly therewith, reference is made to the explanation therefor in the previous or the following descriptive sections. Conversely, and in order to avoid making the drawings too complicated and hinder immediate understanding, reference signs that are of less direct significance do not appear in all figures. For this purpose, reference is made to the respective other figures.

In the embodiment described below, the needle device according to the invention is equipped with a needle bed configured as a needle roller. However, the needle device according to the invention might also be equipped with a needle bed designed as a flat or curved plate and not as a needle roller. All of the variations described in the following relating to a needle roller can be applied similarly to a needle bed in the form of a plate.

Figure 1:
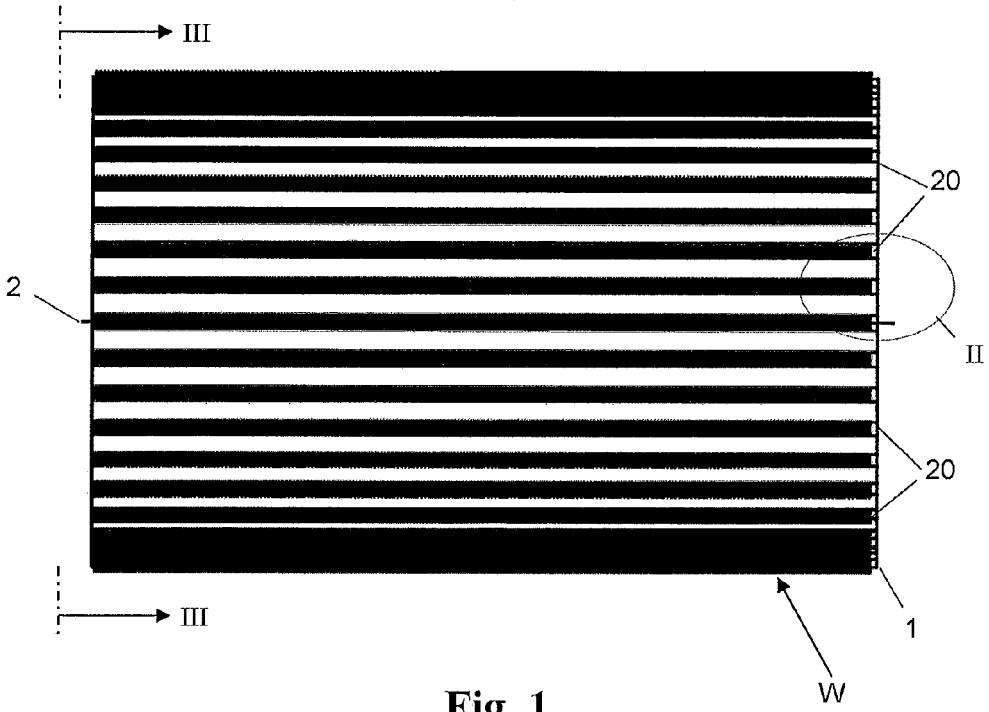
FIG. 1—is a side view of a needle device according to the invention with a needle bed configured as a needle roller, FIG. 2—is an enlarged view of detail II in FIG. 1, FIG. 3—is a frontal view of the needle roller along line III-III in FIG. 1, FIG. 4—is a frontal view similar to FIG. 3, but without the needle carrier, FIG. 5—is a side view of a first variant of a needle element, FIG. 6—is a detail cross-section along line VI-VI in FIG. 5, FIG. 7—is a cross-section through a needle carrier with needle elements along line VII-VII in FIG. 8, FIG. 8—is a side view of a section of a needle carrier with needle elements, FIG. 9—is a top view (plan view) of the section of the needle carrier with needle elements of FIG. 8, FIG. 10—is a plan view of a section of the needle carrier with the needle elements in an alternative orientation, FIG. 11—is a side view of a second variant of a needle element, FIG. 12—is a detail section along line XII-XII in FIG. 11, and FIG. 13—is a sketch explaining how needle elements are produced.
Figure 2:
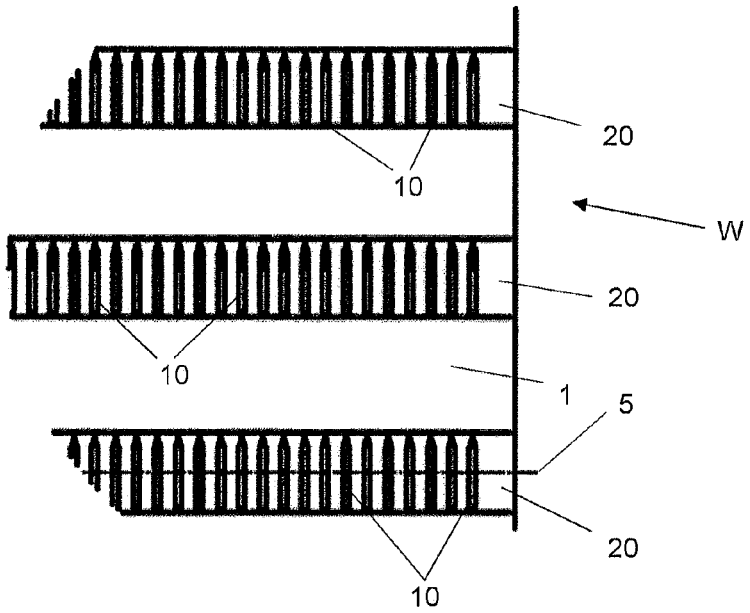
Figure 3:
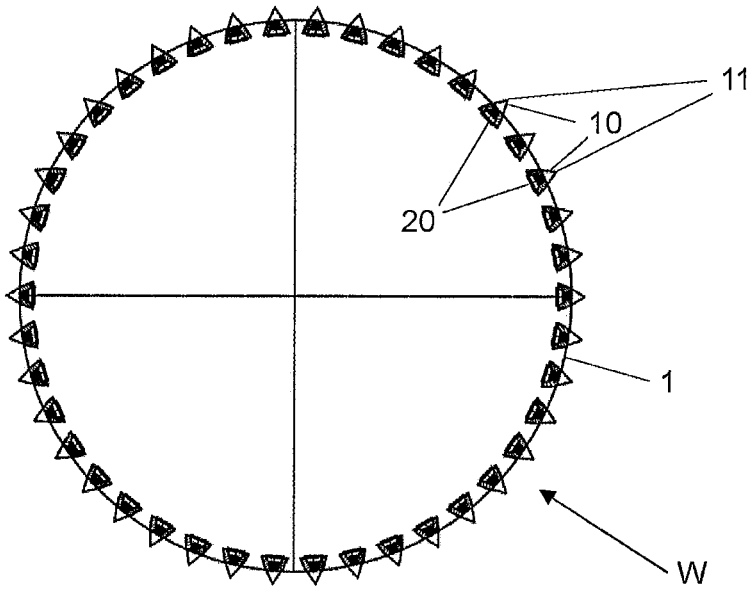

The needle device shown in the drawing essentially consists of a needle bed in the form of a needle roller, designated as a whole by W (FIG. 1). A plurality of needle elements 10 (FIGS. 2 and 3), each provided with a tip 11, is arranged on circumference 1 of needle roller W in such a manner that the needle elements 10 protrude from the needle roller W and the tips 11 thereof point radially away from the roller circumference 1 and ideally have the same (radial) distance (height) from the circumference (FIG. 3). The needle elements 10 are fastened on or in bar-like needle carriers 20 which are in turn mounted on or in the circumference 1 of the needle roller W, as may be seen most clearly in FIG. 3.

Figure 4:
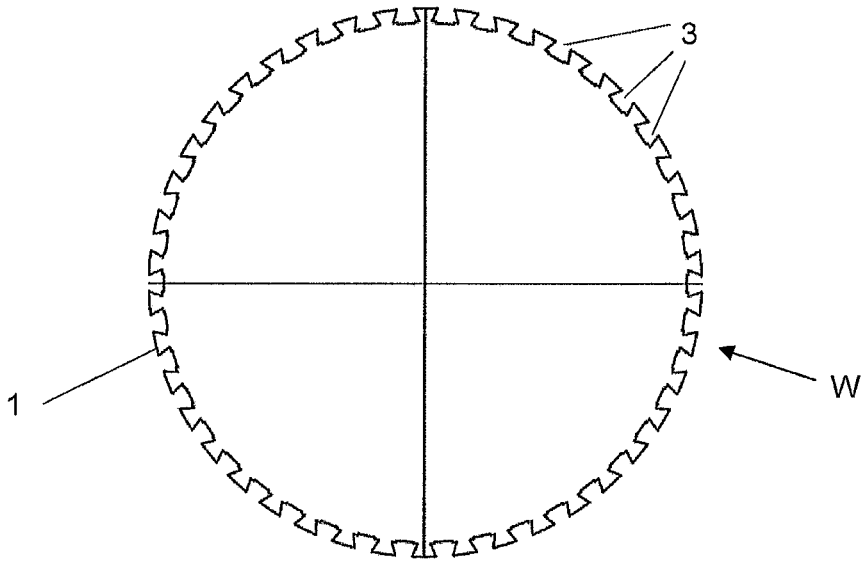

The needle roller W is provided at its circumference 1 with a plurality of longitudinal grooves 3 that are parallel to roller axis 2 and to surface lines of the needle roller and extend over practically the entire length of the roller, and which essentially have an approximately trapezoidal cross section that flares inwardly (FIG. 4). The needle carriers 20 are designed as profiled bars that extend substantially over the entire length of the roller with an approximately dovetail-shaped cross-section, the outer contour of which is substantially complementary to the cross-sectional shape of the longitudinal grooves 3. The needle carriers 20 are inserted lengthwise (longitudinal direction 5, FIG. 2) in the longitudinal grooves 3 and secured against axial displacement by fastening means which are not shown. If necessary, the needle carriers 20 may easily be removed from needle roller W and replaced or exchanged.

Needle rollers with needle elements arranged on needle carriers are known per se, so to this extent the needle device according to the invention requires no further explanation for a person skilled in the art. The present invention is primarily concerned with the design of the needle elements 10 and the fastening or mounting thereof on the needle carriers 20. The following description will deal with these aspects of the invention in detail.

According to a first essential aspect of the invention, the needle elements 10 are designed as flat, planar blades having a cutting edge that extends from the tip 11. In this context, the term flat is understood to mean that the cross sections of the needle elements have a clearly elongated shape, that is to say the cross section thereof is substantially greater in one dimension than in a dimension perpendicular thereto. The needle elements 10 are preferably formed by a flat plate made of steel for example, and therefore have a substantially rectangular cross-sectional shape (apart from the cutting edge). It has been found that needle elements equipped with cutting edges are considerably more suitable than conventional round needles for fibrillating softer plastic films with a higher content of polyethylene, particularly due to the greater precision that is achievable therewith.

Figure 5:
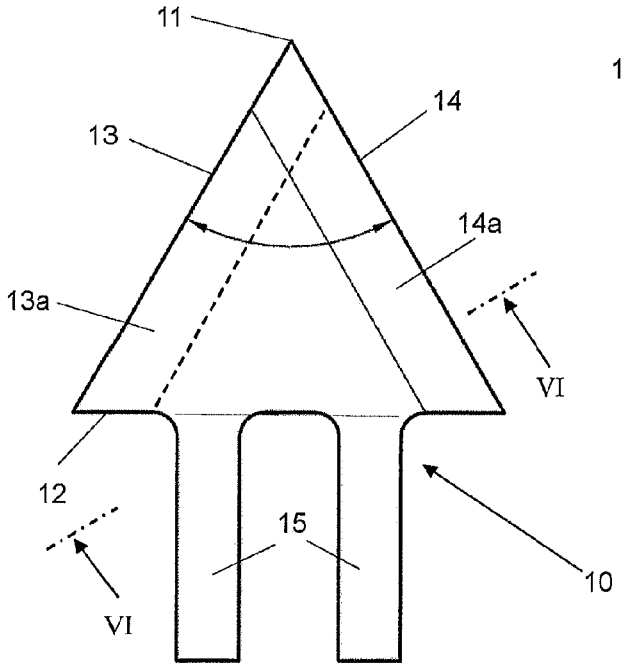
Figure 6:
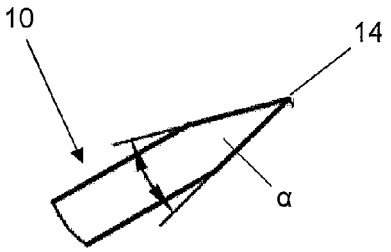
Figure 7:
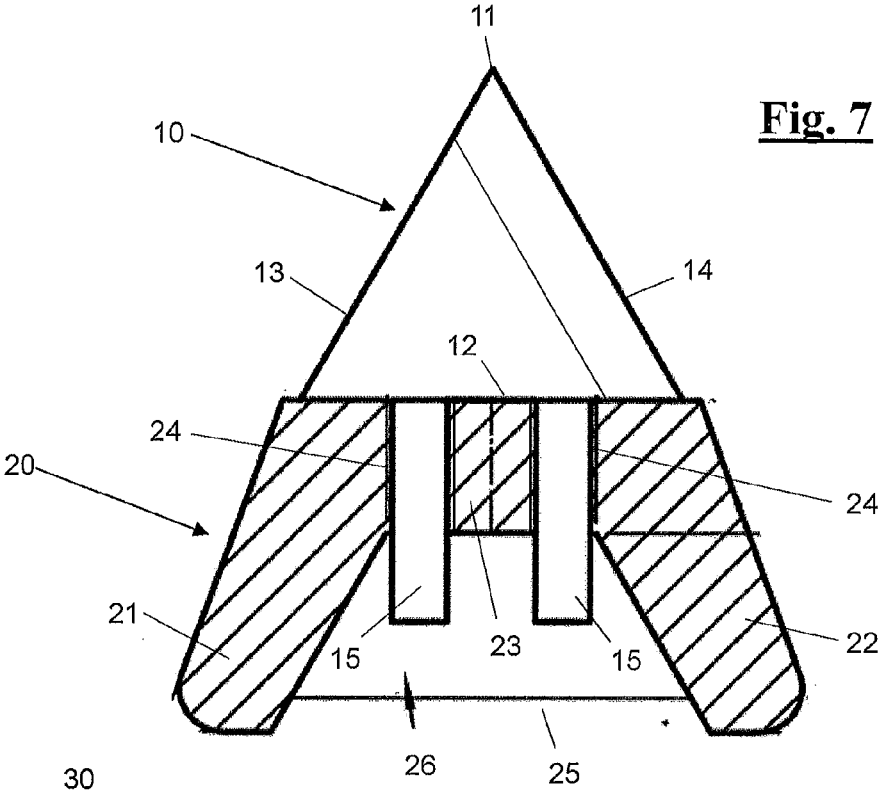

FIGS. 5 and 6 show a typical, preferred form of a needle element 10. It may be seen that the upper part of needle element 10 is in the shape of an equilateral triangle. The length of the sides or edges is typically about 3.5 mm. The needle element 10 comprises a base edge 12 opposite tip 11 thereof and two side edges 13 and 14 which converge from base edge 12 to tip 11. When the needle elements are mounted, base edge 12 is aligned perpendicularly to the radial direction and tangentially to the circumference of the needle roller. The needle element 10 is in the form of a thin steel plate of substantially constant thickness (for example about 0.3 mm). Only a narrow border portion 14*a* is chamfered (for example by appropriate grinding) toward side edge 14 (FIG. 6), so that the side edge 14 forms a (relatively sharp) cutting edge. The cutting angle is denoted with a in FIG. 6. The cutting edge extends from tip 11 of needle element 10 as far as base edge 12, which is substantially flush with needle carrier 20 when the needle element 10 is installed (FIG. 7).

Optionally, a second edge region 13*a* may also be provided with a cross section that tapers toward the side edge 13, so that the other side edge 13 also forms a cutting edge. The two cutting edges may have the same or different cutting angles. The advantages of needle elements with two cutting edges extending away from tip 11 will be discussed below.

The steel needle elements 10 may also be provided with coatings that reduce wear and thus prolong service life. It is also possible to manufacture the needle elements 10 or at least the cutting edges thereof from sintered or ceramic material.

Another essential aspect of the invention relates to the fastening of the needle elements 10 to the needle carriers 20. For this purpose, the needle elements 10 are provided with mounting members in the form of two bar-like legs 15, which extend in the plane of the triangular portion of the needle elements substantially perpendicularly away from the base edge 12 of needle elements 10. With these mounting members or legs 15, the needle elements 10 are attached to the needle carriers 20. FIG. 7 shows this in detail.

The needle carriers 20 are constructed as elongated, profiled bars and each comprises two side parts 21 and 22 connected by a bridge part 23. The two side parts 21 and 22 extend diagonally outward from the bridge part 23, thus creating the previously mentioned dovetail profile of the needle carriers 20. Between them, the two side parts 21 and 22 and the bridge part 23 form a hollow space 25. The bridge part 23 is fully perforated by two mounting holes 24. The needle elements 10 are seated with the base edge 12 thereof on the bridge part 23 and the mounting members or legs 15 of the needle elements 10 extend through the mounting holes 24 into the hollow space 25. The hollow space 25 is almost completely (but at least in the area of legs 15) filled with an adhesive 26 that surrounds the legs 15 of the needle elements 10 and thus fixes the needle elements 10 permanently and securely on the needle carrier 20. The adhesive 26 may be for example a thermosetting epoxy resin based adhesive. As the needle elements 10 are positioned with the base edge 12 thereof in the needle carrier 20, a particularly stable fastening and support of the needle elements 10 is achieved. Since the leg-shaped mounting members 15 pass through the bridge part 23 of the needle carrier 20 and into the hollow space 25 thereof, bonding is particularly easily effected and may be carried out on each needle carrier for example for all of the needle elements 10 to be fastened thereto by filling the hollow space 25 with adhesive 26 along the entire length of the needle carrier. Finally, the mounting openings 24 may be produced relatively easily, since that can be created as normal drill holes, wherein the inside diameter thereof corresponds substantially to the width of the leg-shaped mounting members 15.

FIGS. 2, 7, 8 and 9 illustrate the arrangement of the needle elements 10 on the needle carriers 20. In the embodiment of needle roller W and needle carriers 20 illustrated in these figures, the needle elements 10 are orientated with respect to the needle roller W such that the centre planes 16 thereof (relative to the thickness of the needle elements), that is to say the triangular surfaces, are aligned parallel to a normal plane 4 on axis 2 of the needle roller W. Relative to the needle carriers 20, the needle elements 10 are orientated such that that the centre planes 16 thereof are aligned perpendicularly to the longitudinal direction 5 of the needle carriers 20. This orientation is particularly suitable for fibrillating applications of the needle device according to the invention.

Figure 10:
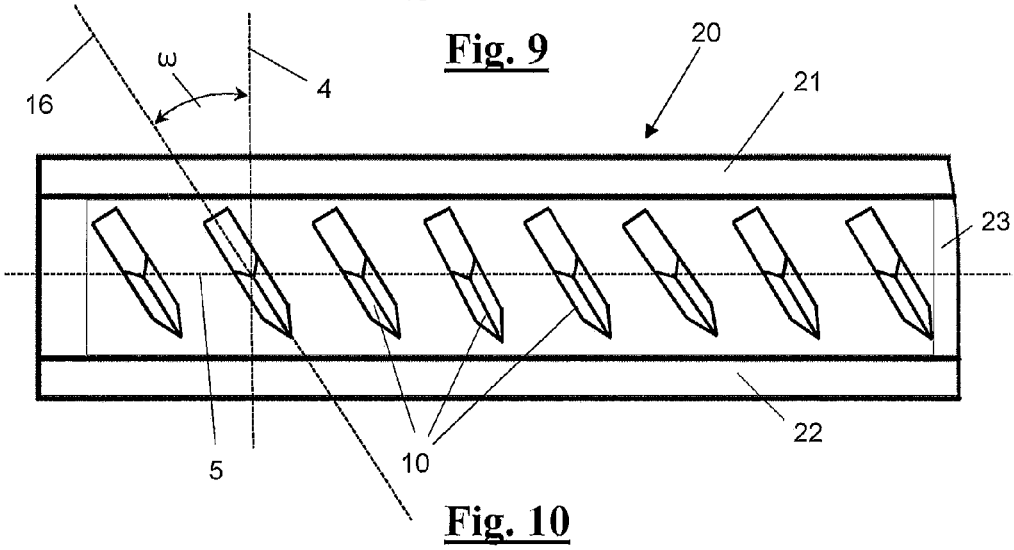

FIG. 10 shows another embodiment of a needle carrier 20, in which the needle elements 10 are orientated such that the centre planes 16 thereof are at an angle $\omega>0°$ relative to said normal plane 4 to the needle roller axis and at a complementary angle $90°-\omega$ to the longitudinal direction 5 of the needle carriers 20. In extreme cases, it is possible for angle $\omega=90°$ so that the flat sides of the needle elements 10 are aligned with the longitudinal direction of the needle roller. This orientation of the needle elements 10 is particularly suitable for perforation applications of the needle device according to the invention. The device can be optimized for the respective purpose by appropriate choice of angle $\omega$.

When the device is in practical use, the needle elements 10 and particularly the tips 11 and the edges 14 thereof are subject to wear. When the needle elements 10 are mounted in the needle carriers 20, worn needle elements 10 (even individual components) can be replaced relatively easily by replacing all or even single needle carriers 20 specifically. If the needle elements 10 mounted in the needle carriers 20 are each equipped with two cutting edges, it is also possible to remove the needle carriers 20 from the needle roller and rotate them through 180° for reinserting them, so that the needle elements 10 are shifted through 180° from their original orientation, and unused cutting edges are thus rotated into position for use. The service life of the needle elements 10 is doubled in this manner. If the two edge areas 13*a* and 14*a* are ground differently (different cutting angles $\alpha$), the cutting edges 13 and 14 will have different (more or less aggressive) cutting behaviours. The cutting performance may thus be adapted to the material quality of the article to be processed by inserting the support needles 20 in the needle roller W in one or the other direction.

Figure 13:
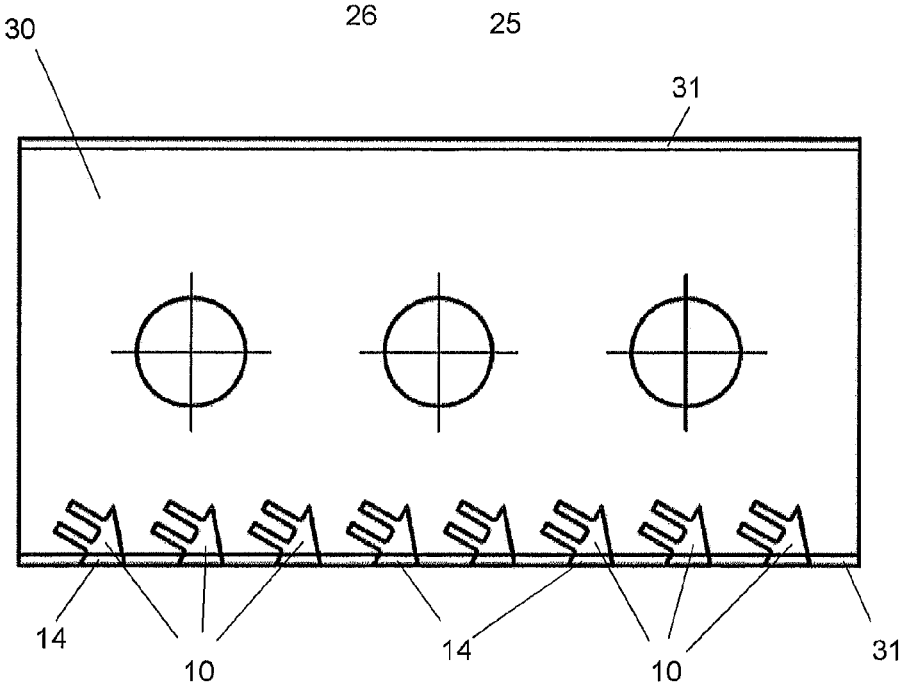
Figure 8:
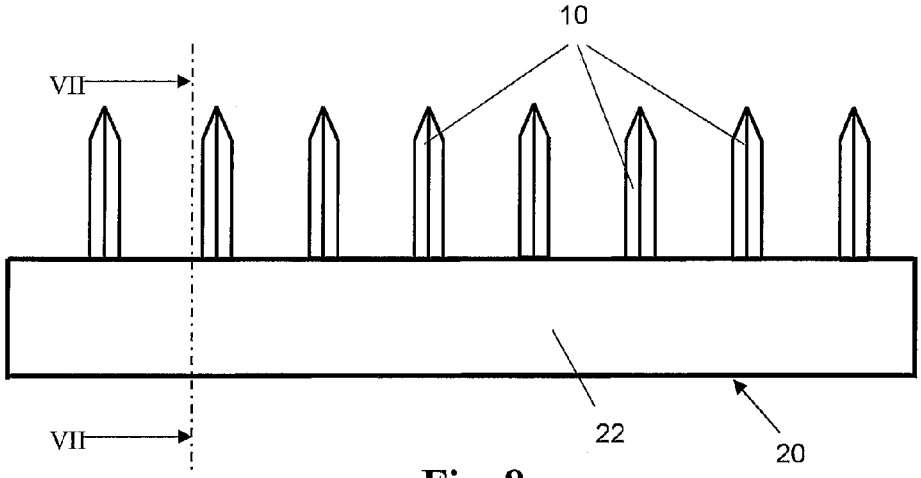
Figure 9:
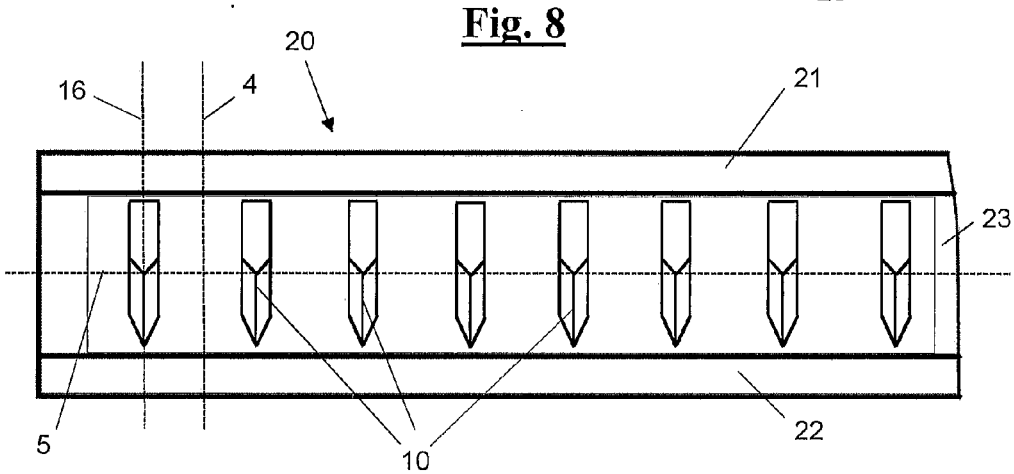

In principle, the needle elements 10 can be produced by stamping or cutting out of a thin metal sheet, wherein the cutting edges 14 or 13 and 14 are formed by appropriate grinding. According to a further essential aspect of the invention, grinding may be omitted if a thin metal sheet that already has a cutting edge is used as the starting material. This is shown clearly in FIG. 13. Here, the starting material is an industrial blade 30, for example similar to a commercially available razor blade, of suitable dimensions, which is provided with two cutting edges 31. A plurality of needle elements 10 are then fabricated from this industrial blade 30 by punching or laser cutting, wherein the needle elements 10 to be fabricated are oriented on the industrial blade in such a way that the cutting edges 31 of the industrial blade 30 or respective parts thereof form one of the cutting edges of the needle elements 10.

Figure 11:
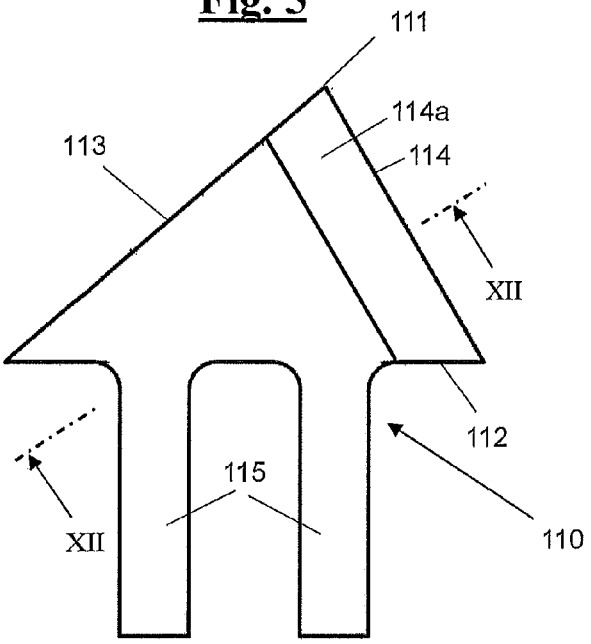
Figure 12:
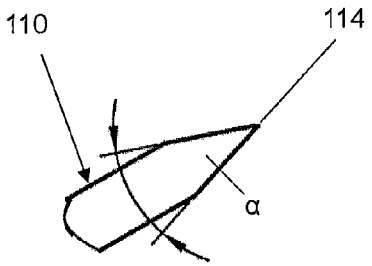

FIGS. 11 and 12 show a modification of a needle element. Unlike the needle element 10 of FIGS. 5 and 6, the top of the needle element designated here as needle element 110 is in the form of a scalene triangle. Again, tip 111 is opposite a base edge 112 and two side edges 113 and 114 converge from the base edge to the tip 111. The side edge 114 is again formed as a cutting edge by a constantly tapered edge area 114*a*, wherein the cutting angle $\alpha$ is represented purely for exemplary purposes as slightly more obtuse than in the needle element 10 of FIGS. 5 and 6. In this variant too, two substantially bar-shaped members or legs 115 extend away from the base edge 112. Different cutting characteristics may be achieved by varying the triangular shape or the angle geometry thereof. This embodiment of the needle element may also be provided with two cutting edges, and similar advantages to those offered by the embodiment of FIGS. 5 and 6 may be obtained. The needle elements 110 may also be orientated at any angle between 0° and 90° relative to the longitudinal direction of the needle carriers.

The invention claimed is:

1. A needle device with a needle bed, on which a plurality of needle elements provided with tips are arranged in such a manner that the needle elements protrude from the needle bed and the tips thereof point away from the needle bed, wherein the needle elements are flat blades each of which having at least one cutting edge extending from the tip of the needle element toward the needle bed, and are inserted in bar-shaped needle carriers, which are in turn fastened on or in the needle bed, wherein the portions of the needle elements protruding from the needle bed each have a substantially triangular shape, wherein the portions of the needle elements protruding from the needle bed each have a base edge located opposite the tip and two side edges extending from the base edge to the tip, wherein at least one of the side edges is a cutting edge, and wherein the needle elements comprise two leg-shaped mounting members extending away from the base edge for fastening to the needle carrier.

2. The needle device according to claim 1, wherein each of the two side edges forms a cutting edge.

3. The needle device according to claim 1, wherein the needle carriers have mounting openings in which the leg-shaped mounting members of the needle elements engage.

4. The needle device according to claim 1, wherein the needle elements are supported with their base edges on the needle carriers.

5. The needle device according to claim 3, wherein the needle elements are glued into the bar-shaped needle carriers by their mounting members.

6. The needle device according to claim 3, wherein the bar-shaped needle carriers each have two side parts inclined toward one another and a bridge part connecting said side parts, the mounting openings are each arranged in the bridge part of the needle carriers, the leg-shaped mounting members of the needle elements pass through the mounting openings and extend into a hollow space formed in the needle carriers by the side parts and the bridge part of the needle carriers, and that the hollow space is filled with an adhesive at least in the area of the mounting members.

7. The needle device according to claim 1, wherein the bar-shaped needle carriers are inserted removably in grooves of the needle bed.

8. The needle device according to claim 1, wherein the needle elements are orientated on the needle carriers in such a manner that the flat sides or centre planes thereof are at an angle from 0°-90° to a normal plane perpendicular to a longitudinal direction of the needle carriers.

9. The needle device according to claim 1, wherein the needle bed is a needle roller.

10. The needle device according to claim 8, wherein the needle elements are oriented on the needle carriers in such a manner that the flat sides or centre planes thereof are at an angle of 0° to a normal plane perpendicular to a longitudinal direction of the needle carriers.

* * * * *